United States Patent [19]

Collins

[11] Patent Number: 4,852,879

[45] Date of Patent: Aug. 1, 1989

[54] GOLF PUTTER HEAD

[76] Inventor: Truman F. Collins, 3550 Cherry St. Rd., Springfield, Mo. 65804

[21] Appl. No.: 63,577

[22] Filed: Jun. 17, 1987

[51] Int. Cl.[4] ..... A63B 53/04

[52] U.S. Cl. ..... 273/164; 273/80 A; 273/80 C; 273/169

[58] Field of Search ..... 273/80 A, 80 C, 81.3, 273/169, 167 H, 170, 171, 172, 167 F, 164, 183 E, 183 D

[56] References Cited

U.S. PATENT DOCUMENTS

| | | | |
|---|---|---|---|
| D. 228,930 | 10/1973 | Leigh | 273/80 C |
| 3,176,987 | 4/1965 | Johnston | 273/80 C |
| 3,332,684 | 7/1967 | Solheim | 273/81.3 |
| 3,516,674 | 6/1970 | Scarborough | 273/169 |
| 3,954,265 | 5/1976 | Taylor | 273/80 C |
| 3,966,210 | 6/1976 | Rozmus | 273/169 |
| 4,650,191 | 3/1987 | Mills | 273/80 A |
| 4,693,478 | 9/1987 | Long | 273/80 C |

FOREIGN PATENT DOCUMENTS

| | | | |
|---|---|---|---|
| 899562 | 6/1962 | United Kingdom | 273/80 C |

*Primary Examiner*—George J. Marlo

*Attorney, Agent, or Firm*—Fitch, Even, Tabin & Flannery

[57] ABSTRACT

Disclosed is a golf putter head having a body with an elongated ball-contacting surface and a generally hollow center disposed between two massive ends. The putter head has a center of mass aligned with the center of the ball-contacting surface. The putter head includes a handle-engaging hosel having a central axis aligned with the centroid of the ball-contacting surface. The hossel is configured to arrange the axis of the putter shaft so that its also is aligned with the center of the ball-contacting surface, and lies generally along that surface. A central web aligned with the center is provided in the hollow cavity. The central web has an upper inclined surface bearing readily-visible indicia to aid in aligning the center of the putter surface with the golf ball.

7 Claims, 2 Drawing Sheets

GOLF PUTTER HEAD

BACKGROUND OF THE INVENTION

1. Field of the Invention

The invention relates to a head for a golf club and more particularly, to the head of a putter for putting a golf ball once it has reached the green.

2. Description of the Prior Art

As is well known to those who play the game of golf, putting often accounts for nearly half of a golfer's total strokes over an average course. Although a wide variety of putter designs have been made available, many golfers are still seeking a putter which will assist them in improving their game and consequently lowering their total score.

The art of rolling a golf ball across a putting green toward a definite desired point requires a considerable amount of acquired skill. In the field of regulation play, the putter is probably the most important of the fourteen regulation clubs used in golf because, in part, a player is restricted to the use of a single putter throughout a complete round of competition. Consequently, a player must rely on a single putter club design to meet all conditions in the various putting areas throughout a golf course. These conditions vary from green to green and from position to position on a particular green.

It is well known that the techniques and muscle groups employed in putting are quite different from those associated with the use of other clubs. The distances and particularly the tolerances involved in putting can be quite small. For example, if a relatively short put misses the cup by only an inch it requires another stroke which must be added to the player's total score. Players frequently find it difficult to analyze their putting performance, in part because the range of motion of the club head is quite small and the muscle groups employed in directing the putter head to the ball are difficult to observe. Further, the putter head strikes the ball at a very low speed compared to other clubs, making it extremely difficult to pinpoint any design errors in the club head. For these reasons, many non-professional, and some professional golfers credit their undesirably high scores to a lack of acquired skill, although some attention has been paid to measuring the performance of the putter itself. For example, one well known manufacturer of golf club putters has published in national advertisements and other promotional material lateral dispersion tests for its particular putter. Attention has also been paid to other performance indicators, such as the putter's moment of inertia which, if made large enough, is believed to reduce twisting of the putter head on impact with the ball. Putters of this type tend to have a much larger size and total weight, requiring the golfer to acquire significantly different skills and muscle control to adapt to the heavier putter head. It is, however, generally desirable to further reduce lateral dispersion without unduly increasing the size and particularly the weight of the golf club head.

As in other sports which use a strung racket, golf club putters have what is commonly referred to as a "sweet spot", a term associated generally with a noticeable improvement in momentum transfer. This feature is important not only to avoid undershooting or overshooting a desired target, but is also important because playing areas of different slopes require different initial velocities of the golf ball to assure the desired trajectory or path of travel across a sloping putting surface.

It is further desirable to provide some type of aiming means which visually aids a player in anticipating and maintaining the desired path of travel of the golf club head relative to the target to which the golf ball is to be directed.

Although improvements of various types have been made in the design of golf club putters, no one design has the features necessary to ensure a minimum dispersion performance of the putter.

SUMMARY OF THE INVENTION

Accordingly, it is an object of the present invention to provide a head for a golf putter which reduces or substantially eliminates the tendency of the club to twist upon impact with the golf ball.

Another object of the present invention is to provide a golf putter which is easy to align with a golf ball to assure a proper path of travel.

Yet another object of the present invention is to provide a golf putter having a reduced sensitivity to twisting when a golf ball is hit off-center.

These and other objects of the present invention which will become apparent from studying the appended description and drawings is provided in a golf putter head comprised of a body having an elongated ball-contacting surface with a generally hollow center disposed between two massive ends. The head has a center of mass generally aligned with a centroid of the ball-contacting surface. Handle-engaging means are provided for engaging an elongated handle such that the central axis thereof lies generally along the ball-engaging surface and extends generally through the centroid thereof.

BRIEF DESCRIPTION OF THE DRAWINGS

In the drawings, wherein like elements are referenced alike.

DETAILED DESCRIPTION OF THE PREFERRED EMBODIMENT

Figure 2:
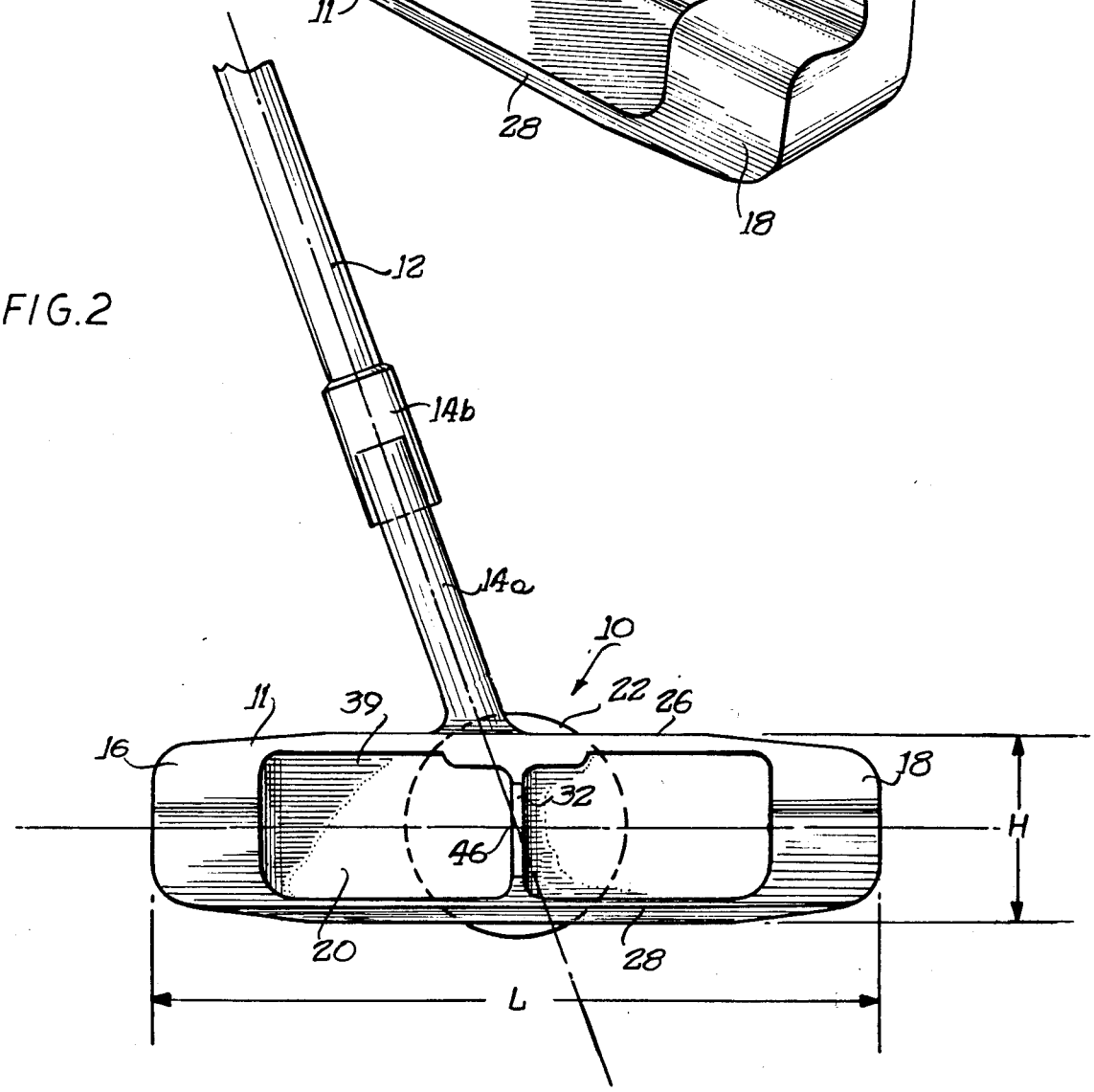
FIG. 2 is a rear elevational view of the putter head of FIG. 1.
Figure 3:
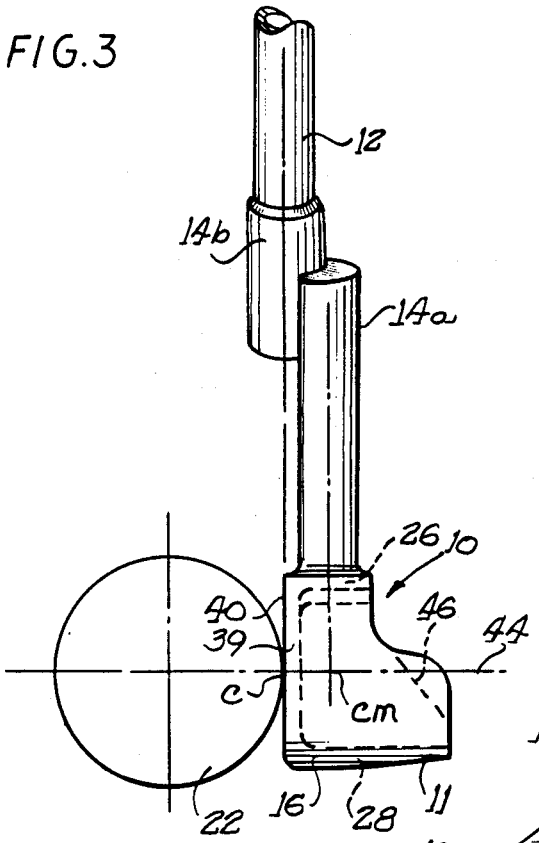
FIG. 3 is an end elevational view taken from the heel, or left-hand end of the putter head of FIGS. 1 and 2.
Figure 4:
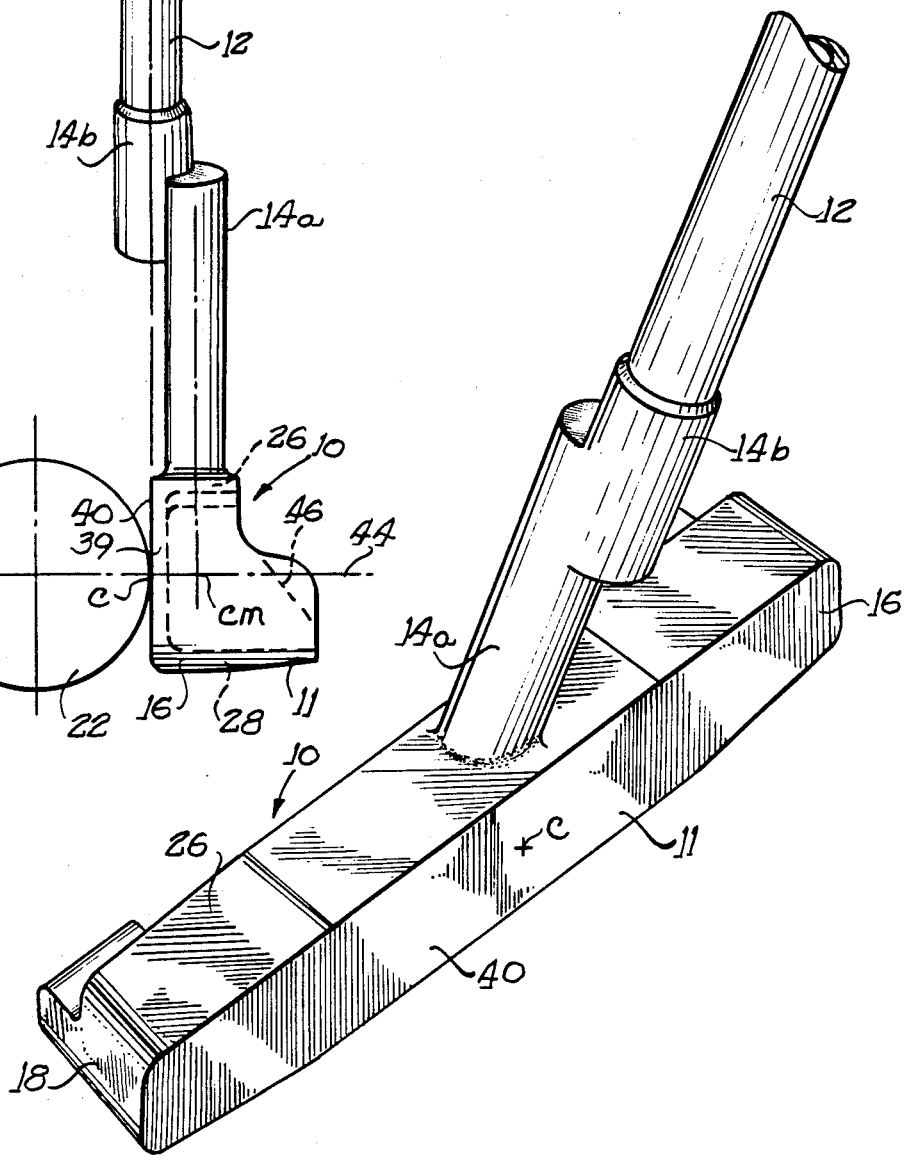
FIG. 4 is a front perspective view of the putter head of the preceding figures showing the ball-engaging face thereof.

Referring now to the drawings, a head of a golf putter constructed according to aspects of the present invention is indicated generally at 10. With particular reference to FIGS. 2–4, the major body portion 11 of the putter head 10 is connected to a handle-like shaft 12 through a hosel 14. The putter body 11 generally includes a pair of spaced, relatively massive end portions 16, 18 on either side of a generally hollow central portion 20. The end portions 16, 18 are commonly referred to as the "heel" and "toe" portions of the club head, with the heel being disposed closer to the player as the club is swung to impact a golf ball, such as the golf ball 22 illustrated in FIGS. 2 and 3.

According to one aspect of the present invention, the central cavity 20 is elongated from heel to toe, and is formed between upper and lower relatively thin walls 26, 28. The central cavity 20 is generally C-shaped in cross-section,and comprises a front wall 39 carrying the ball-contacting face of the putter, intermediate the top and bottom walls 26, 28. In the preferred embodiment illustrated in the Figures, the putter body 11, as well as the hosel 14 are preferably made from a unitary precision investment casting of either brass or berylium copper metal of uniform density. While the putter body may be formed from other suitable materials, it is important in the illustrated embodiment that the materials used have a generally uniform density throughout the putter head and hosel construction, to assure proper positioning of the center of mass of head 10, for reasons which will become apparent herein.

Also illustrated in the Figures, is an optional, generally vertical central web 32 which is generally mutually perpendicular to the front, top and bottom walls 39, 26 and 28, respectively, and which generally bisects the central cavity 20 into side-by-side portions. The central web 32 includes an upper surface 34 which is inclined toward the front or ball-contacting face 40 of the putter body. The upper surface 34 of the central web 32 preferably carries highly-visible indicia, such as brightly colored paint or the like, to provide an indicator pointing toward the center of the club face, as well as the center of mass of the putter head to achieve numerous advantages to be described herein.

As can be seen most clearly in FIGS. 3 and 4, hosel 14 is generally "Z"-shaped, preferably comprised of two partly overlapping, generally parallel but offset cylindrical portions, the lower portion **14*a* being joined to the upper wall 26 of the putter body and the upper socket-like cylindrical portion 14b being joined to the handle-like shaft 12. As illustrated in FIG. 3, the offset of hosel 14 positions the center line or axis of shaft 12 to lie in the plane of the ball-contacting or front face 40 of the club body. The offset is in the direction that the putter is swung when addressing the ball. As will be seen, the axis of shaft 12 is also positioned to intersect the center C of face 40 and to be horizontally aligned with the center of mass of the head 10. The alignment between the axis of shaft 12 and the front face 40 is one aspect of the present invention which helps eliminate rotation of head 10 about the axis of shaft 12**, upon impact with the golf ball.

This anti-rotation feature is further enhanced by the particular construction of body 11, wherein a relatively lightweight central portion 20 is disposed between the appropriately spaced, massive ends 16, 18 to enlarge or at least create what is generally called a "sweet spot", a term generally indicating an area of improved performance. In particular, the improved performance of putter head 10 includes a greatly reduced sensitivity to off-center hits as well as increased momentum transfer between the putter head and the golf ball. According to other aspects of the present invention, the sweet-spot is enlarged to an extent heretofore unrealized. The length of the putter head, L, ranges between 3.1 and 3.5 golf ball diameters, and is preferably 3.33 diameters long. The length of the hollow, generally central cavity 20 ranges between approximately 65% and 75% of the length L, to effectively increase the sweet-spot area, making the putter more tolerant to off-center contact with the golf ball. It has also been found that a length of the central hollow cavity approximately equal to 70% of the length of the putter head, is particularly advantageous for spacing the end weights or massive end portions 16, 18 for effectively increasing the sweet-spot area of one embodiment of the golf putter which will now be described. In the one embodiment, the weight of the club head 10, that is, the body 11 and the lower hosel portion **14*b* together weigh approximately 350 gms. The height H of the putter head of this embodiment is 1¼ inches, and the length L of the putter head is 5 inches. The two massive ends 16, 18 together comprise an estimated 50% of the weight of the golf club body and lower hosel portion. This amount of mass in the end weights of the body, separated by horizontal distances of the central hollow cavity 20 according to the principles explained above, provides a central sweet-spot area approximately one golf ball diameter in length. This sweet spot produces substantially insignificant lateral dispersion, for golf balls contacted at any point along the face 40** generally within one golf ball radius on either side of the center C. Accordingly, an optimum response in both directional stability and momentum transfer (driving force) at impact with the golf ball is provided over a sweet spot as wide as one golf ball diameter.

Figure 1:
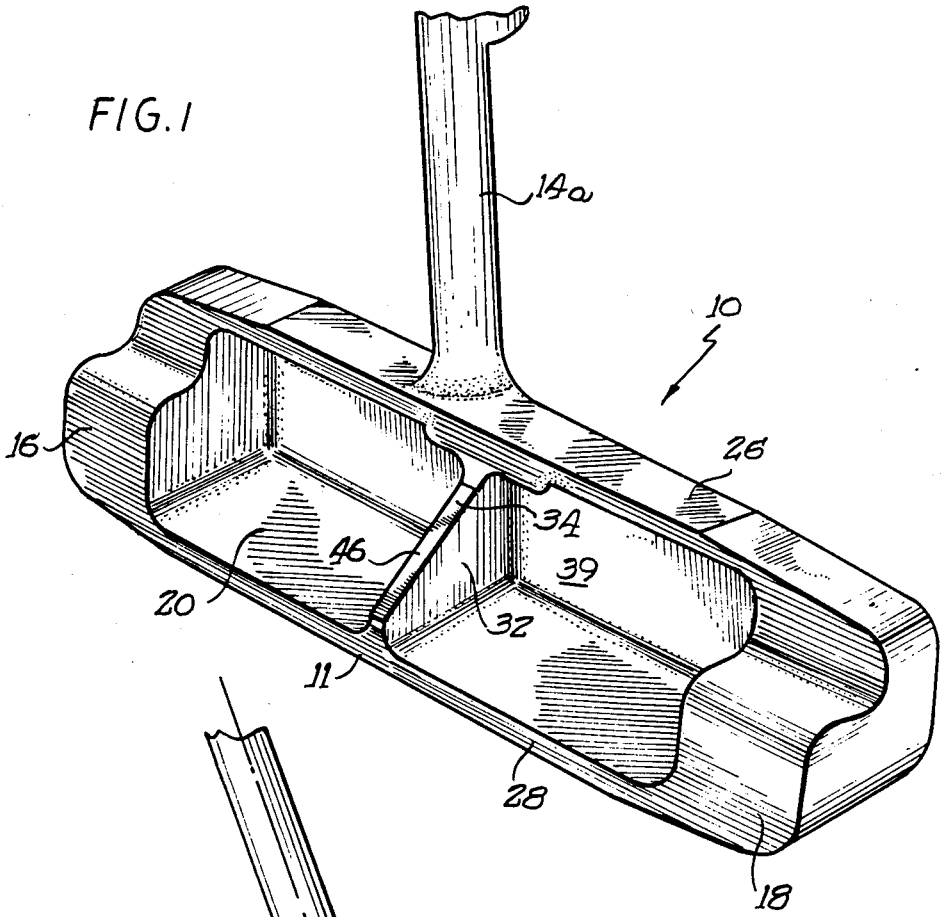
FIG. 1 is a rear perspective view of a head of a golf putter illustrating aspects of the present invention.

Various aspects of the present invention for orienting components of the putter head and hosel will now be described in greater detail. With reference to FIG. 2, the axis of shaft 12 is aligned with the center C of club face 40 so as to be horizontally offset from the center of mass CM of the head 10 in the direction of putter swing. FIG. 3 illustrates a theoretical line 44 intersecting the center C of club face 40, and the center of mass CM of the head 10 (i.e., body 11 and lower hosel portion **14*b*.) Line 44 is perpendicular to putter face 40 and extends in a horizontal direction along the direction of swing of the putter. The line 44 is perpendicular to club face 40 and appears as point 46 in FIGS. 1 and 2. One important aspect of the present invention is that the center of mass, CM, of the putter head 10 is aligned with the center C of the head face 40 so as to be horizontally displaced rearwardly therefrom. Another important aspect of the present invention is that the lower hosel portion 14*a* has a central axis located to at least intersect theoretical line 44, and preferably to intersect the center of mass CM located at a particular point along line 44. These features, along with the alignment of the axis of shaft 12 so as to lie in the plane of head face 40 and to intersect center C, effectively eliminates the tendency of the club head twisting, either about the axis of shaft 12 or some other point of rotation upon impact with the golf ball 22**.

According to another aspect of the present invention, the upper, shaft-connecting hosel portion **14*b* is horizontally aligned with the axis of the lower portion 14*a*. That is, while being horizontally offset, both upper and lower portions of hosel 14 overlie each other in the desired direction of the stroke of the putter club. The socket-like upper hosel portion 14*b* is coaxially aligned with shaft 12 so that the common axis intersects the center of the ball contacting face 40 of the club head. It has been found that variance from the horizontal alignment of either the shaft 12 or lower hosel portion 14*b*** with both the center of mass and the center of the club head will, at impact with the golf ball, tend to create a twist in the club head either along the axis of the shaft or along another point of rotation, thereby introducing lateral dispersion relative to the direction of stroke and intended path of travel of the golf ball.

An accompanying advantage, as pointed out above, in aligning the center of mass of the putter head with the center of mass of the golf ball is that maximum driving force or momentum transfer to the golf ball is realized, with minimal diversion of the momentum into a twisting of the club head. Thus, when constructed according to the principles of the present invention, the putter head not only reduces angular dispersion of the path of golf ball travel, but also reduces distance errors, particularly short-fall in the distance of golf ball travel due to diverting of the stroke force away from the golf ball into a deflecting force, reorienting the position of the putter head upon impact with the golf ball.

Figure 5:
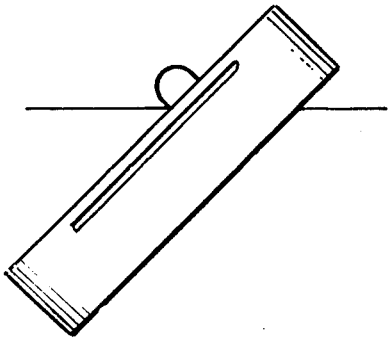
FIG. 5 PRIOR ART
FIG. 5 is a bottom view of a typical prior art golf putter to illustrate the rest position of the club when placed on a level, hard surface.
Figure 6:
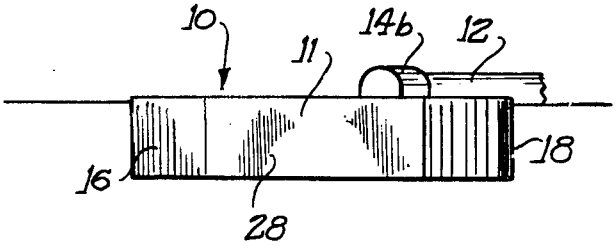
FIG. 6 is a bottom plan view of the golf putter of FIGS. 1–4, illustrating the rest position of the golf putter when placed on a level, hard surface.

Contrary to prior art designs, one feature of the present invention is a refinement of the calculation of the center of mass of the club head, which has been found to provide a heretofore unattained rotational stability and improved momentum transfer. The calculation of center of mass of the club head is important in that, for the reasons explained above, the center of mass must be horizontally offset from the club face center in the direction of club swing. The putter head is preferably constructed such that the mass of the lower hosel portion 14*a* (attached to the upper wall 26) but not the upper portion 14*b* connected to the shaft 12) is included in the determination of the center of mass, CM, as described above. That is, the club body 11 and lower hosel portion 14*a* attached thereto is considered as one unit, with the upper hosel portion 14*b* considered as an extension of the shaft. As can be seen in the Figures, the preferred hosel construction has more mass per unit length than shaft 12, which, also, is generally formed of a lighter weight metal. Differences in the center of mass calculation, if the lower hosel construction is not included, can substantially increase the overall dispersion of the putter club. Referring to FIG. 6, when the shaft 12 of the golf club putter according to the present invention is placed on a hard, horizontal level surface, with the putter head 10 extending beyond that surface and being free to assume a rest position, that rest position will be as illustrated in FIG. 6, where the longitudinal axis of the putter body 11 rests at a near perfectly horizontal orientation. Referring to FIG. 5, in contrast, many prior art putters having shafts or hosels offset from the center of mass of the putter head (e.g., offset with respect to the direction of swing or stroke of the golf club) causes the putter body to seek a rest position inclined from the horizontal surface on which the shaft is laid. It will now be appreciated, in light of the explanation above, the rest position of the putter head resulting from the alignment of its center of mass with the shaft provides a ready indication of the lateral dispersion which can be expected upon contact with a golf ball, with the angle of inclination of the putter head from a horizontal position generally indicating the magnitude of dispersion.

The horizontal alignment of the shaft axis, center of the putter face, and center of mass of the putter head, all intersecting a common line 44 extending generally in the direction of club swing together provide a putter head which inherently seeks and maintains the direction of stroke at address, thereby allowing the user to maintain a very light grip on the club which greatly enhances his feel for controlling distance and direction, even on extremely long putts. To aid in aligning the direction of stroke in the desired direction, the central web 32 may be provided, as described above, to carry an upper surface 46 bearing readily visible indicia, such as bright colored paint or the like. However, the central web 32 is not essential for providing the above-described advantages, and can be omitted altogether, it being one aspect of the present invention that the central portion of the putter head be essentially devoid of significantly massive portions, as distinct from some putter designs which concentrate mass at the point where the putter head is intended to contact the golf ball. This latter aspect of the present invention effectively reduces lateral dispersion or, in other terms, enlarges the central sweet-spot area of the putter head, (as defined above) thereby reducing if not eliminating a twisting or dislocating reaction of the putter head when the golf ball is contacted at points adjacent but not precisely aligned with its center C.

With reference to FIGS. 2 and 3, according to another aspect of the present invention, the vertical height H of body 11 ranges between 70 and 80% and is preferably about 75% of the diameter of the golf ball 22 to provide easy alignment of the center C of the body with a horizontally oriented diameter of golf ball 22 when the sole or bottom wall 28 of the putter head just clears the putting surface. This feature, along with the preferred location of center C bisecting the height H and length L of the body simplifies the precise positioning of the putter head relative to the golf ball.

According to another aspect of the present invention, the club face 40 is designed to have 0 to 1 degree loft, which has been found to be the range of loft angle for maximum rotation of the golf ball immediately after impact. This imparts a proper tracking to the golf ball during its path of travel, by imparting to the golf ball full forward rotation thereof at the moment of impact with the club face. This avoids any lack of rotation of the golf ball after impact, which causes skipping, bouncing, and off-line travel, plus variations in the distance of travel. To further enhance this performance, the face 40 has a final grinding operation directed along the length of the putter head to produce a generally smooth surface, but one which is not highly polished. The final grinding operation produces relatively fine (small, shallow) horizontal lines which allow minimum resistance to the ball at contact, thereby providing an immediate rolling action therein at impact.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A golf putter head comprising:

a body having an elongated generally planar ball-contacting surface (40) with a generally hollow center disposed between two massive ends (16, 18);

said head having a center of mass (CM) generally aligned behind a center C of said ball-contacting surface along a line (44) extending generally in the direction of swing of the golf putter; and means (14) for engaging a handle comprising an elongated hosel (14*a*) extending from the top of said head and having a longitudinal axis extending generally through the center of mass (CM) of said head and a generally parallel socket (14*b*) for receiving a handle having a longitudinal axis, said socket 14(*b*) being laterally offset from said hosel (14*a*) and having an elongated axis lying in the plane of said ball-engaging surface (40) so as to extend through the center (C) thereof, said socket (14*b*) adapted for coaxial alignment with the longitudinal axis of said handle (12).

2. The head of claim 1 further comprising an interior wall in a central portion of said head, dividing the hollow center of said body into a pair of side-by-side hollow cavities.

3. The head of claim 2 wherein said interior wall includes indicia on its surface generally aligned with both the center of mass (CM) of said head and the center C of said ball-engaging surface.

4. The head of claim 2 wherein said hollow center is generally C-shaped in cross section and comprises a front wall having said ball-contacting surface, intermediate a top and a bottom wall, with said means for engaging a handle joined to said top wall, said front, top and bottom walls extending between said massive ends and said interior wall generally mutually perpendicular to said front, said top and said bottom walls.

5. The head of claim 1 wherein said body has a vertical height (H) less than the diameter of a golf ball to be putted by said putter, ranging between 70% and 80% of the golf ball diameter, to facilitate alignment of the center of mass (CM) of said head with the center of mass of the golf ball.

6. The head of claim 5 wherein said putter head has an axial length (L) longer than the golf ball to be putted by said putter, ranging between 3.1 and 3.5 times the diameter of the golf ball.

7. The head of claim 5 wherein the hollow center of said head is elongated along the central axis of the head, having a length ranging between approximately 65% and approximately 75% of the axial length of the putter head.

* * * * *

UNITED STATES PATENT AND TRADEMARK OFFICE

CERTIFICATE OF CORRECTION

PATENT NO. : 4,852,879

DATED : August 1, 1989

INVENTOR(S) : Truman F. Collins

It is certified that error appears in the above-identified patent and that said Letters Patent is hereby corrected as shown below:

IN THE SPECIFICATION:

In the Abstract on line 8, change the word "hossel" to --hosel--.

In the Abstract on line 9, change the word "its" to --it --.

In column 5, line 27, change "connected" to --(connected--.

Signed and Sealed this

Twenty-seventh Day of March, 1990

*Attest:*

JEFFREY M. SAMUELS

*Attesting Officer*

*Acting Commissioner of Patents and Trademarks*